United States Patent [19]

Hura

[11] 4,246,488

[45] Jan. 20, 1981

[54] RADIATION COLLIMATOR

[75] Inventor: Michael Hura, Wickliffe, Ohio

[73] Assignee: Picker Corporation, Cleveland, Ohio

[21] Appl. No.: 19,083

[22] Filed: Mar. 9, 1979

[51] Int. Cl.[3] ..... G21F 5/04; G21K 1/04

[52] U.S. Cl. ..... 250/513; 250/511

[58] Field of Search ..... 250/511, 510, 512, 513, 250/514, 505, 402

[56] References Cited

U.S. PATENT DOCUMENTS

| | | | |
|---|---|---|---|
| 2,887,586 | 5/1959 | Reiniger | 250/491 |
| 3,023,314 | 2/1962 | Hura | 250/511 |
| 3,502,872 | 3/1970 | Norgren | 250/511 |
| 3,643,095 | 2/1972 | Shuster | 250/511 |
| 3,678,233 | 7/1972 | Faw et al. | 250/510 |
| 3,767,931 | 10/1973 | Williams | 250/505 |
| 3,829,701 | 8/1974 | Hura | 250/513 |
| 3,980,407 | 9/1976 | Hill | 250/511 |

*Primary Examiner*—Alfred E. Smith
*Assistant Examiner*—Thomas P. O'Hare
*Attorney, Agent, or Firm*—Watts, Hoffmann, Fisher & Heinke Co.

[57] ABSTRACT

A compact and light weight radiographic collimator including two pairs of radiation absorbent shutters connected together by a parallelogram linkage which provides a nested arrangement when the shutters are in their full open position yet provides an aligned relationship when fully closed. An off-focal vane construction in which the vanes are moved reciprocally is also disclosed.

The shutters and vanes may be either manually or automatically adjusted. Manual adjustment is automatically limited to the maximum safe open position.

A collimator adjusting drive train using constantly meshing gearing and a slip clutch is employed. A series of filter plates of varying thicknesses are provided. The operator can select the filtration desired by positioning each filter plate in either its filtering or nonfiltering position and then insert the stack of plates into a slot. A sensor provides an indication of when the filter assembly is positioned in the collimator.

Light beam centering and field size indication are provided from a single light source.

16 Claims, 15 Drawing Figures

RADIATION COLLIMATOR

REFERENCE TO RELATED PATENTS

1. U.S. Pat. No. 2,887,586, issued May 19, 1959 to W. G. Reininger, entitled "X-Ray Focusing Apparatus", herein the CENTERING PATENT.

2. U.S. Pat. No. 3,023,314, issued Feb. 27, 1962 to Michael Hura, entitled "X-Ray Apparatus", herein the COLLIMATOR PATENT.

3. U.S. Pat. No. 3,502,872 to Edwin A. Norgren, entitled "Automatic Shutter Control for an X-Ray Spot Filmer", herein the AUTOMATIC ADJUSTMENT PATENT.

4. U.S. Pat. No. 3,829,701, issued Aug. 3, 1974 to Michael Hura, entitled "Radiation Collmator", herein the OFF-FOCUS PATENT.

BACKGROUND OF THE INVENTION

1. Field of the Invention

This invention relates to medical X-ray apparatus and more particularly to an improved radiographic collimator.

In medical diagnostic studies with X-rays a beam of a desired size and cross-sectional configuration is delineated by a device known as a collimator. Typically a radiographic collimator has adjustable longitudinal and transverse sets of X-ray absorbent diaphragms which control the so-called field size, that is the transverse configuration and dimension of, an X-ray beam.

A major consideration in medical X-ray diagnosis is to minimize the radiation dosage administered to a patient during any given radiographic study. Accordingly it is important that when a radiographic exposure is to be made, the collimator diaphragms are positioned to provide exposure of a sheet of X-ray film but to avoid an oversized field size. That is radiation should not pass through the patient in regions around or at least adjacent to the field of interest because such radiation does not produce any diagnostic information.

The delineation of a beam of appropriate size is complicated by the fact that the distance between the source of X-rays and the imaging device is a variable. As an X-ray tube is moved toward a film of a given size, the apex angles of a given rectangular beam must be enlarged if the entire sheet of film is to be exposed. Conversely, the apex angles must be reduced when the X-ray tube is moved away from the film or a patient will receive needless extra dosage because the beam is larger in cross-sectional dimension in the plane of the film than is necessary to expose the film. 2. Description of the Prior Art Proposals have been made for automatically varying diaphragm settings to control field size as source-to-image distance (SID) varies. One such proposal is disclosed in U.S. Pat. No. 3,502,872 to Edwin A. Norgren, entitled "Automatic Shutter Control for an X-Ray Spot Filmer".

Appropriate diaphragm setting is a function not only of the SID but also of the size film which is to be used. Accordingly, sensors are provided in a Bucky tray, as an example, to sense the size of a film cassette in the tray, provide electrical signals to a collimator control so that the beam settings are of appropriate size for the film in the tray.

Collimators are typically mounted on X-ray tubes which are suspended from the ceiling by a ceiling tube amount or alternately supported within an X-ray table.

In either event, it is necessary to counterbalance the weight of the collimator. In addition, especially with a collimator within the table, it is not only desirable that the collimator be light weight but also important that it be compact.

SUMMARY OF THE INVENTION

The collimator made in accordance with this invention is highly compact and light weight. A major factor in achieving compactness is that one set of the diaphragms comprises two pairs of radiation absorbent shutters connected together by a parallelogram linkage which provides a compact, out-of-the-way nested arrangement when the shutters are in their full open position yet provides an aligned relationship when fully closed to completely block a beam from emergence from the collimator.

Another aspect of the invention that contributes to the compactness of it is an off-focal vane construction in which the vanes are moved reciprocally rather than pivotally as has been the case with the prior art, permitting the dimension of the collimator axially of the beam to be shorter than has been the case previously.

A further feature of the collimator of this invention is that shutters may be either manually or automatically adjusted. If there is manual adjustment to a position in which the diaphragms are too far open for a given film size and source-to-image distance, the shutters are automatically driven inwardly to the maximum safe open position.

A novel arrangement for obtaining both manual and automatic drive is provided. A drive train using constantly meshing gearing is employed. The drive train includes a slip clutch which can be relatively easily caused to slip with manual adjustment while it also provides a reliable automatic drive connection. Thus, unlike prior devices, manual adjustment is accomplished without rotating the motor used in automatic adjustment.

Another feature of the invention is the provision of a novel and simplified filtering arrangement. A main and supplemental filter plates of varying thicknesses are provided. Each supplemental filter plate has an aperture and a filtering and nonfiltering position. The operator can select the filtration desired by positioning each supplemental filter plate in either its filtering or nonfiltering position and then insert the stack of plates into a slot. Thus, the filters not being used are stored in the same location as when they are in use for filtration in a very compact and simple arrangement.

In addition, a sensor provides an indication of when the filter assembly is, and when it is not, appropriately positioned in the collimator. When the filter assembly is not appropriately positioned in the collimator either because it is absent or not fully and properly inserted, operation of the associated X-ray tube is automatically limited to a kilovoltage level of 50 Kv maximum. Once the filtration assembly is in and properly seated, higher energy levels can be employed. This system obviously protects the patient against exposure to excessive radiation should an operator fails to properly insert the filter assembly in the collimator.

One important feature of the invention is the mechanical mounting and movement of the off-focus and in-focus diaphragms. In the preferred embodiment, the off-focus diaphragms are mounted for movement transverse the direction of X-ray propagation. No pivotal mount is needed so that most effective X-radiation control and collimation is achieved. The transverse diaphragm motion provides greater field flexibility and allows more compact diaphragm vane design.

Apparatus is provided for co-ordinating movement of the collimator diaphragms with the source to image X-ray distance. Standards have been adapted with the X-ray apparatus industry for proper field size depending upon the distance the patient is removed from the source. The present invention provides a technique for sensing the source to image distance and providing optimum diaphragm positioning to provide maximum field coverage.

Certain convenience features are also included in the collimator system. A light centering feature enables the user to see the extent of the field as well as the center of that field. This enables the user to carefully position the X-ray tube in relation to the patient. Dials are included on the collimator which inform the user of pertinent data such as the source to image distance and the extent of the field to be exposed.

From the above it should be apparent that one object of the invention is to provide an automatic system for controlling the radiation field size according to industry wide standards. A second object is to provide an improved design and method for co-ordinating the movement of both in-focus and off-focus collimator diaphragms. Other features and objects of the invention will become understood when the detailed description is considered in conjunction with the accompanying drawings.

DESCRIPTION OF THE PREFERRED EMBODIMENT

Figure 5:
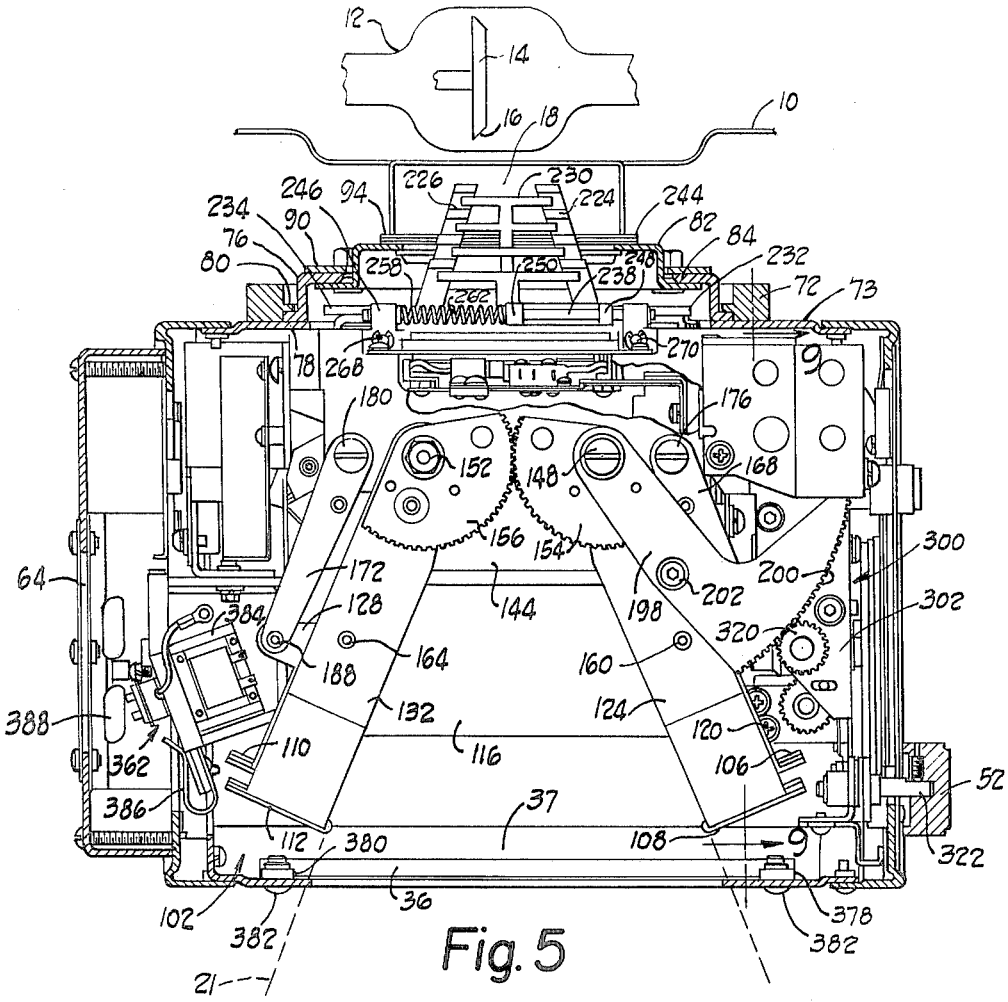
FIG. 5 is a cross-sectional view of the collimator as seen from the plane indicated by the line 5—5 of FIG. 1, and a schematic representation of an X-ray tube.

Referring to the drawings and to FIG. 5 in particular, an X-ray apparatus is shown including an X-ray tube housing 10 which supports and houses an X-ray tube 12. The X-ray tube 12 includes an anode 14 having a focal spot 16 which is bombarded by electrons to cause the emission of X-radiation.

A collimator 20 is supported by a tube housing 10 and functions to delineate an X-ray beam 21 of rectangular cross-section. The collimator 20 includes a housing 22 and a mounting assembly 70 for connecting the collimator housing 22 to the tube housing 10.

A vane and shutter mechanism, including on and off focus assemblies 102, 104, is disposed within the collimator housing 22 for delineating the perimeter of the beam. A drive assembly 300 controls the position and movement of the vane and shutter mechanism. A centering light assembly 360 provides an indication during collimator adjustment of the size and location of a collimated X-ray beam to be produced. A filter assembly 440 is provided for attenuating radiation.

I. The Collimator Housing 22

Referring to FIGS. 1–4, the collimator housing 22 defines spaced input and output end openings 24, 26. The housing includes a front panel 28, a rear panel 30, and side panels 32, 34. The input end opening 24 is surrounded by the mounting assembly 70. An off field portion of the vane and shutter assembly projects from the housing 22 through the input end opening 24. The output end opening 26 includes a bottom window 36 (FIG. 5) having crosshairs indicated in an expanded and schematic manner at 37. The crosshairs functon as an aid to locations of the collimator 20, and the X-ray tube 12, with respect to a patient.

Figure 1:
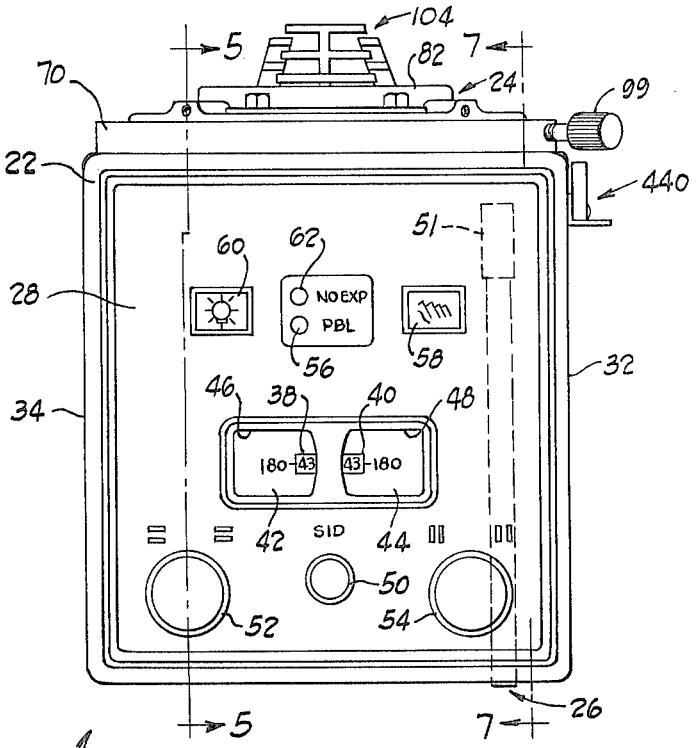
FIG. 1 is a front elevational view of an X-ray collimator constructed in accordance with the invention.
Figure 2:
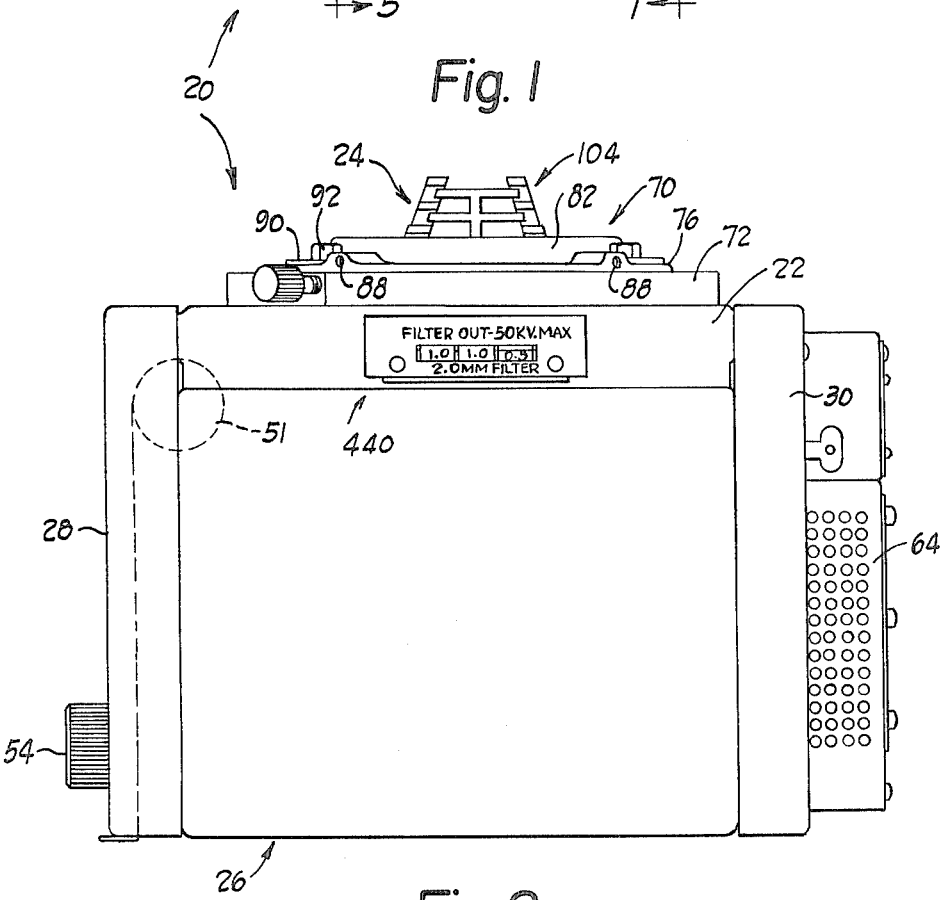
FIG. 2 is a side elevational view of the collimator of FIG. 1, showing the right side, as viewed in FIG. 1.
Figure 3:
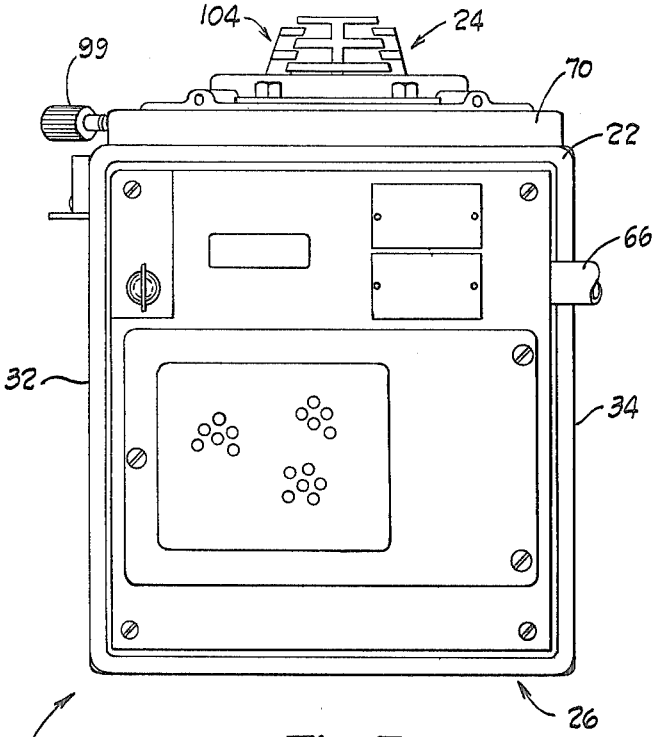
FIG. 3 is a rear elevational view of the collimator of FIG. 1.

The front panel 28 carries controls and signalling devices to carry out and indicate the various collimator functions, see FIG. 1. It is important that the distance from the X-ray tube to the plane of an X-ray film, or other imaging device, be know with reasonable accuracy. As the X-ray tube 12 is brought closer to the X-ray film and, the patient, the area of the beam 21 should be increased to cover the entire imaging device. It is also important that the beam size is not too large to avoid excessive irradiation of the patient.

With the collimator of the present invention, adjustments are available from a zero field size, that is with the X-ray beam fully blocked, to a maximum opening of 90 cm. square. Since the maximum field size which is appropriate is a function of the X-ray source to image distance (SID) it is important for the operator to know both the accurate SID and the field size setting to which the collimator is adjusted.

In order to accomplish this, a pair of field size indicator discs 38, 40 (portions of which are shown in FIG. 1) are supported for rotation adjacent the front panel 28. A pair of windowed S.I.D. selector discs 42, 44 are supported for rotation behind the front panel and respectively in front of the indicator discs 38, 40. The front panel 28 includes a pair of apertures 46, 48 through which portions of the discs 38, 40, 42, 44 can be viewed.

Rotation of the windowed S.I.D. selector discs 42, 44 is controlled by an S.I.D. selector knob 50 extending outwardly of the front panel 28. Upon rotation of the selector knob 50, the S.I.D. selector discs 42, 44 are indexed at 90° intervals to locate windows corresponding to the selected S.I.D. in the apertures 46, 48. The operator will see only that portion of the field size indicator discs 38, 40 showing field sizes to which the beam be delineated for the selected S.I.D. In order for the operator to know which S.I.D. to select a retractable tape measure 51 is disposed within the housing 22 adjacent the panel and its tape is accessible at the lower portion of the panel 28.

A pair of field size selector knobs 52, 54 project outwardly of the front panel 28. The knob 52 provides manual control of transverse dimension of the X-ray beam, while the knob 52 provides manual control of the longitudinal dimension. The function of each knob is indicated by adjacent markings on the front panel 28.

FIG. 1 illustrates a selected S.I.D. of 180 cm. For that particular S.I.D. and a given film size there is a maximum permissible shutter opening. The operator can irradiate the maximum permissible field size or less and the field size which will be irradiated is displayed by the indicator discs 38, 40.

The collimator 20 also has the capability to automatically select field sizes to properly irradiate standard X-ray film sizes at selected S.I.D.s. This capability is known as "positive beam limitation", or P.B.L. and the operability of this feature is indicated on the front panel 28 by an indicator light 56. If the operator tries to create a field size larger or smaller than that permitted for a given S.I.D. and film size, the driver assembly 300 automatically functions to drive the vane and shutter assembly back to maximum permissible field size.

A control button 58 is provided to de-activate one side of the P.B.L. feature and, when the button 58 is depressed, the button lights indicating that the system is in manually P.B.L. This allows the operator to manually adjust the shutters, longitudinal or transverse, to X-ray field sizes smaller than the cassette size but not larger.

Certain other collimator functions are controlled or indicated by components included as part of the front panel 28. A pushbutton 60 controls operation of the centering light assembly 360 and a safety light 62 indicates, when lighted, certain conditions like being ouf of P.B.L. range or filter is removed, exist and X-ray exposures cannot be made. The collimator functions associated with the pushbutton 60 and the light 62 will be described subsequently.

The rear panel 30 includes a fan cover assembly 64. The fan cover assembly 64 is apertured to permit electrical components within the collimator housing 22 to be cooled. The fan cover assembly 64 also includes an opening through which an electrical input 66 extends.

II. The Mounting Assembly 70

Figure 4:
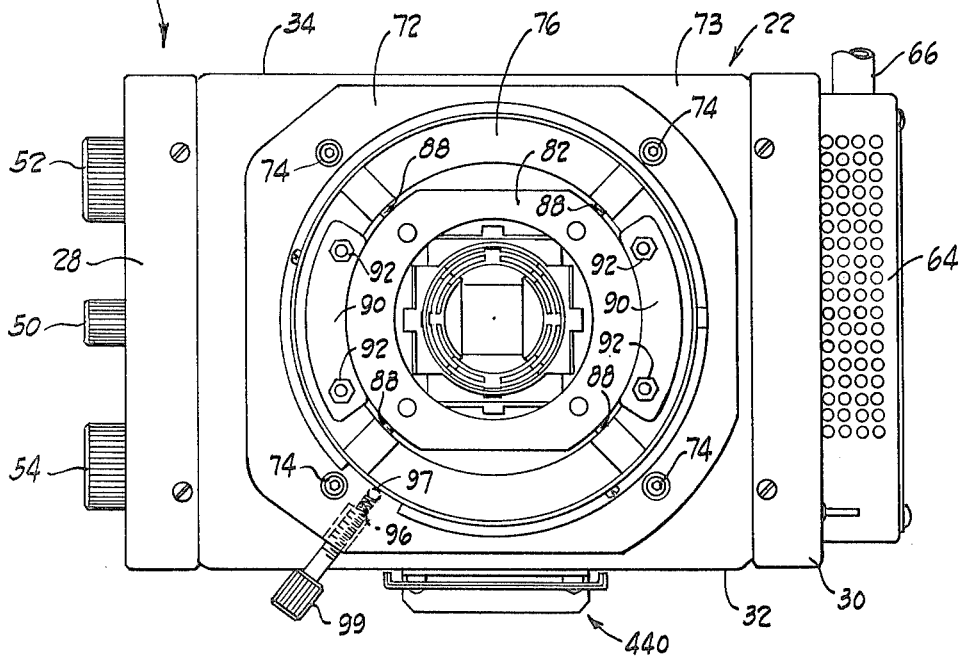
FIG. 4 is a top plan view of the collimator of FIG. 1.

The mounting assembly 70 is secured to the top of the housing 22 and surrounds the input end opening 24 as shown best in FIGS. 4 and 5. The mounting assembly 70 includes a swivel mount 72 secured to a top plate 73 of the housing 22 by fasteners 74. A swivel ring 76 is rotatively mounted above the top plate 73. The ring 76 has an outwardly extending flange 78 which is between the top plate 73 an inwardly extending annular flange 80 carried by the swivel mount 72. This construction holds the ring 76 and the mount 72 together while permitting them to be rotated relatively.

An adapter 82 connects the X-ray tube housing 10 and the mounting assembly 70. The adapter 82 has an outwardly extending annular flange 84 which underlies and engages an inwardly extending flange 86 on the swivel ring 76. The relative lateral positions of the swivel ring 76 and the adapter 82 are adjusted by a plurality of circumferentially spaced set screws 88. Once the swivel ring 76 and the adapter are appropriately located laterally they are fixed in place by a pair of locking plate 90 which clamp the swivel ring 76 and the adapter 82 together by means of fasteners 92. This arrangement provides very precise alignment of the X-ray tube and collimator transversely of the X-ray beam to be delineated. A plurality of shim spacers 94 are fitted intermediate the X-ray tube housing 10 and the adapter 82 so that the collimator 20 can be accurately positioned axially of the beam.

As thus far described, the swivel ring permits the collimator to be rotated freely about the axis of the X-ray beam to be delineated. The purpose of this rotation is to permit the collimator to be moved from one position to another relative to the X-ray tube to locate the front panel and its controls in a desired location for a given study. Once the collimator has been positioned, it is desirable to lock it in its adjusted position. The locking is accomplished by a spring-biaased plunger 96 which is carried out by the swivel mount 72 and releasably engages depressions in the swivel ring 76.

The inner end of the plunger 96 carries a ball 97 and the ball 97, through the plunger 96, is biased by a spring 98 (dotted lines in FIG. 4) into engagement with the swivel ring 76. A threaded knob 99 controls the displacement of the plunger 96. By retracting the knob 99, the biasing force on the plunger 96 eventually is loosened to the point where the ball 97 can move with respect to the ring 76. Thereafter the collimator can be rotated to another position. The collimator can be locked in place there upon tightening of the knob 99 and concurrent engagement between the ball 97 and a depression in the swivel ring 76.

III. The Vane and Shutter Assembly

The vane and shutter mechanism includes an adjustable set of diaphragms which delineate the perimeter of the X-ray beam 21. The vane and shutter mechanism includes a main shutter assembly 102 supported in a lower portion of the housing 22 as well as a so-called off-focus vane assembly 104 interposed between the main shutter assembly 102 and the X-ray tube 12. The function of both the on-focus and off-focus assemblies is described fully in the Off-Focus Patent which is incorporated by reference and further discussion regarding their basic functions is unnecessary here.

The main shutter assembly 102 includes two nested pairs of transverse radiation-absorbing shutters 106, 108 and 110, 112 which are moveable toward and away from one another and the front and rear panels to delineate a transverse beam dimension. Another pair of radiation absorbing shutters 114, 116 are supported independently of the transverse shutter pairs 106, 108 and 110, 112 for movement perpendicular to them to delineate the longitudinal beam limits.

The compactness of the collimator 20 is improved considerably by a parallelogram linkage mounting of the transverse shutters. (See FIGS. 5 and 7). This mounting permits two sets of nested shutters 106, 108 and 110, 112 to move relatively so that each of the four shutters 106, 108, 110, 112 moves relative to the remaining three as beam delineating adjustments are made. As shown in FIGS. 5 and 7, the shutter 106 is supported by arms 118, 120 on opposed sides of the collimator. Similarly the shutter 108 is supported by arms 122, 124. The shutter 110 is supported by arms 126, 128 and the shutter 112 is supported by arms 130, 132. The longitudinal shutters 114, 116 are each supported by a pair of arms with one arm of each pair being shown at 136 and 140 respectively in FIG. 6.

The arms 122, 124, 130, 132 are mounted pivotally to chassis side plates 142, 144 by shoulder screws 146, 148, 150, 152. Sector gears 154, 156 are secured, respectively, to the arms 124, 132 for interconnected concurrent movement to provide a driving relationship among the transverse shutters.

The shutter support arms 118, 120, 126, 128 are rotatively secured to the arms 122, 124, 130, 132, respectively, by shoulder rivets 158, 160, 162 164. In turn, the arms 118, 120, and 126, 128 are connected to the chassis side plates 142, 144 by links 166, 168, 170, 172. The links 166, 168, 170, 172 are rotatively connected to the chassis side plates by shoulder screws 174, 176, 178, 180 and to the arms 118, 120, 126, 128 by shoulder rivets 182, 186, 188. Upper links, two of which are shown at 190, 192 in FIG. 7, are connected to the arms 122, 124, 130, 132 and to the links 166, 168, 170, 172 in a parallelogram arrangement. The upper links 190, 192 include upstanding drive sections 194, 196 which drive components of the off field focus shutter assembly 104 when the main shutters are adjusted.

A segmented drive gear 198 is provided for the transverse shutters. The drive gear 198 includes a toothed portion 200 engageable with the drive assembly 300. The drive gear 198 is pivotally secured to the transversely movable shutters by the shoulder screw 148 and a bottonhead screw 202 which connects the gear 198 to the arm 124. When the gear 198 is driven about its rotational axis defined by the shoulder screw 148, the shutters 106, 108, 110, 112 can be moved from their extreme open position (full line position in FIG. 7) in which each pair is in a nested relation to their completely closed position (dotted line position in FIG. 7).

As seen most clearly in FIG. 7 the mounting member or links for each transverse shutter pair interconnect to form a parallelogram. One pair 106, 108 is supported at one end, for example, by the link 166, and two arms 122, 118. As this pair 106, 108 moves four points coincident with two shoulder screws 146, 174 and two shoulder rivets 158, 182 define such a parallelogram.

Figure 6:
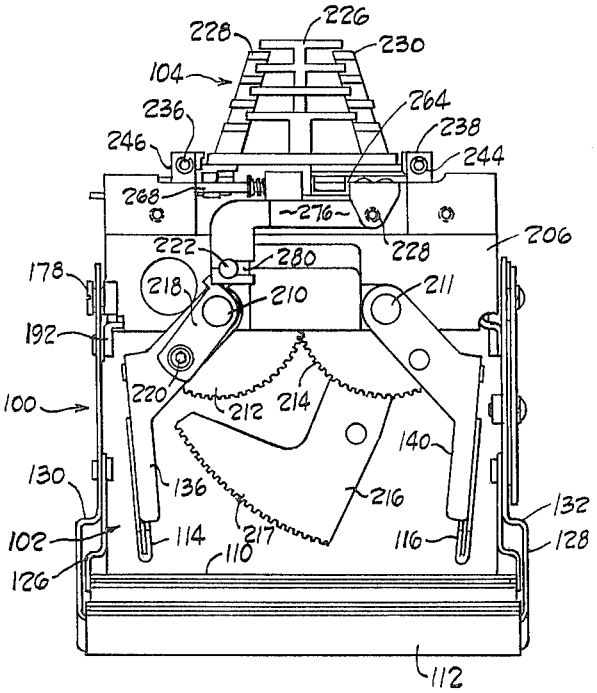
FIG. 6 is a rear view on a reduced scale, of the collimator with its housing with transverse vanes removed for clarity.
Figure 7:
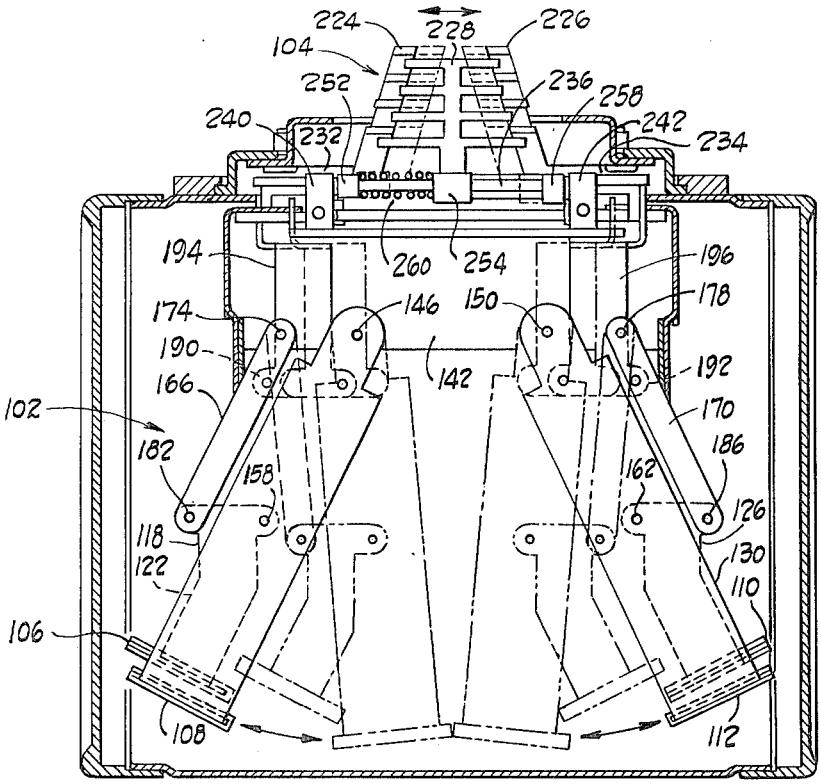
FIG. 7 is a view of the collimator as viewed from the plane indicated by the line 7—7 of FIG. 1 with certain components removed for clarity of illustration.

The mounting and operation of the longitudinal shutters is best shown in FIG. 6. The longitudinal shutters 114, 116 are mounted pivotally to chassis end plate 206 by means of shoulder screws 210, 211 comparable shoulder screws, not shown, mounted the remote ends of the shutters. Sector gears 212, 214 are secured to the arms 136, 140 and mesh with each other in driving relationship. A drive gear 216 is secured through structure which is not shown to the sector gear 214 to pivot about the axis of its shoulder screw. A toothed portion 217 of the drive gear 216 is engaged by the drive system 300. When the drive gear 216 is rotated, the longitudinally movable shutters 114, 116 will be moved toward and away from each other.

An off-field focus drive bracket 218 is connected to the arm 136 and pivots with the arm 136 about the shoulder screw 210. A buttonhead screw 220 adjustably secures one end of the drive bracket 218 to the arm 136. The other end of the bracket 218 carries a drive pin 222 which is employed to drive portions of the off-focus vane assembly 104.

The off-focus vane assembly 104 includes opposed pairs of beam-delineating vanes 224, 226 and 228, 230. The vanes 224, 226 are movable with the transverse shutters and the vanes 228, 230 are movable with the longitudinal shutters. As set forth more fully in the Off-Focus Patent, the vanes are formed by inclined, generally vertically extending stems to which plate-like structures are secured. The plates are spaced along the length of the stems and the transverse and longitudinal plates are interleaved to permit the vane pairs to move toward and away from each other.

In the Off-Focus Patent, the vanes were mounted pivotally and such a mounting required that the interleaved plates be spaced a rather considerable distance as compared with the present construction, along the stem to accommodate the arc which each plate traversed during its back and forth movement. The present invention permits the interleaved plates to be positioned closer to each other so that the overall height of the off-focus vane assembly is reduced.

This compact, off-focus vane assembly is provided by a vane mounting system which supports the vane pairs 224, 226, 228, 230 for reciprocal movement. As in the Off-Focus Patent, the vanes are connected to the on-focus shutter assembly for concurrent movement so that the drive system 300 employed to drive the main shutter assembly 102 also drives the off-focus shutter assembly 104.

The mounting system for the transverse vanes 224, 226 includes vane support brackets 232, 234, FIGS. 5 and 7. The vane support brackets 232, 234 are carried by spaced and parallel guide rods 236, 238 which in turn are supported there by vertical mounting posts 240, 242, 244, 246. The vane support bracket 232 at one side includes a pair of spaced, apertured bosses 248, 250 through which the rod 238 extends. The other side of the vane support bracket 232 is in the form of an apertured boss 252 which is supported by the rod 236 for reciprocal movement. The other vane support bracket 234 is constructed similarly and includes spaced bosses 254, 256 which ride upon the rod 236. The other side of the vane support bracket 234 includes a single boss 258 which rides upon the rod 238. A compression spring 260 is carried by the rod 236 and is fitted between the bosses 252 and 254. A spring 262 is carried by the other rod 238 and is disposed between the bosses 250 and 258. The springs 260, 262 urge the bosses and their connected vane pairs away from each other.

Cross connections, not shown, connect the left hand (as viewed in FIG. 7) drive section 194 to the right hand vane 226 and the other drive section 196 and the vane 224 together. By this construction the off-focus vanes are moved from their solid to dotted line positions concurrently with movement of the main shutter between them solid and dotted line positions. The springs 260, 262 provide an off-focus vane drive system which is free of backlash and, furthermore, the vanes do not bind during their movement because the rods 236, 238 are parallel, the rods are polished, and the springs 260, 232 produce balanced forces.

The mounting system for the longitudinal vanes 228, 230 is similar to that of the transverse vanes 224, 226. Specifically, the vanes 228, 230 are carried by vane support brackets, one of which is shown at 264 in FIG. 6. The support brackets for the vanes 228, 230 correspond to the vane support brackets 232, 234. The longitudinal vane support brackets are carried by polished, parallel rods 268, 270 which in turn are supported by the vertical mounting posts 240, 242, 244, 246. The parallel rods 268, 270 are spaced vertically from and are at right angles with the rods 236, 238. A compression spring 272 is carried by the rod 268, and a comparable spring, not shown, is around the rod 270 to bias the transverse vane support brackets apart, in the same manner as has been described for the vane support brackets 232, 234.

The actuating mechanism for the off-focus vane assembly includes a link 276 (FIG. 6) secured at one end to the vane support bracket 264 by a pivotal connection 278. The other end of the link 276 includes a slot 280 within which the pin 222 rides. When the arm 136 is pivoted counterclockwise as viewed in FIG. 6, the pin 222 also will be pivoted counterclockwise and the link 276 will be advanced to the left. This will urge the vane support bracket 264 to the left against the spring bias exerted by the spring 272. In turn, the vane 230 will be moved toward the vane 228. Concurrently, a link (not shown) supported at the other end of the collimator 20 acts on the vane 228 to advance it to the right as viewed in FIG. 6.

IV. The Drive Assembly 300

Figure 9:
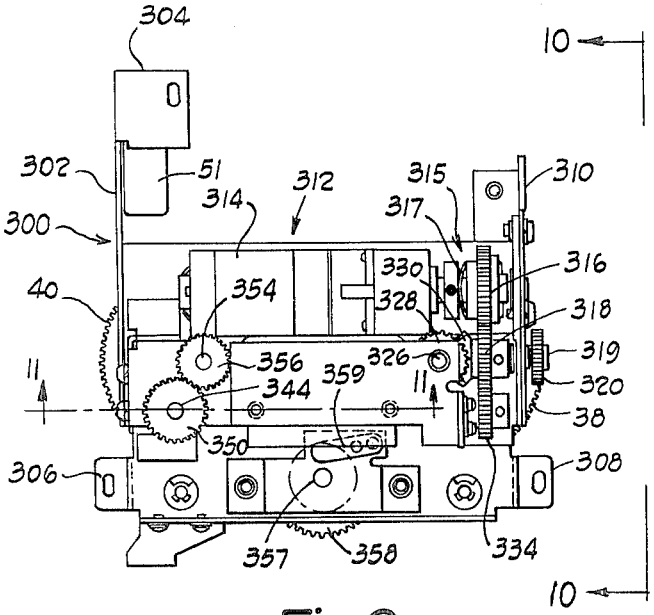
FIG. 9 is an elevational view of a vane and shutter drive assembly as seen from the plane indicated by the line 9—9 of FIG. 5.
Figure 10:
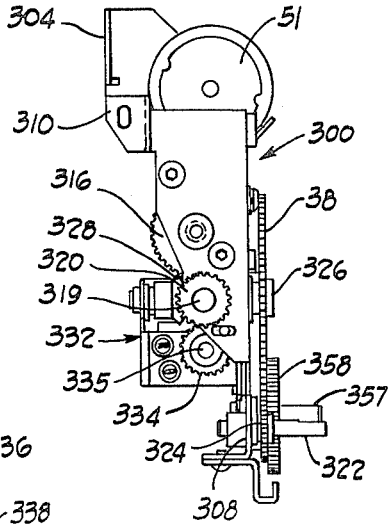
FIG. 10 is a side elevational view of the drive assembly as seen from the plane indicated by the line 10—10 of FIG. 9.

The drive assembly 300 controls the movement of the vane and shutter assemblies 102, 104. Referring to FIGS. 9 and 10 the drive assembly 300 has a drive assembly frame 302 which includes tabs 304, 306, 308 for chassis mounting at locations not shown. The frame 302 also has a tab 310 which is secured to the chassis side plate 144.

A transverse motor subassembly 312 is carried in an upper portion as the frame 302, FIG. 10. The motor subassembly 312 drives the transverse shutters and vanes. The motor subassembly 312 includes an electric gear motor 314 positioned laterally of the collimator 20 and mounted behind the back face of the front panel 28. The output of the gear motor 314 drives a clutch 315, a motor output spur gear 316, and an intermediate spur gear 318. The clutch 315 includes curved washers 317 which are under compression to transmit torque from the gear motor 318 to the output spur gear 316. The spring compression can be adjusted to permit the spur gear 316 to slip relative to the gear motor 314 when about 5.0 inch pounds of torque are attained.

The intermediate spur gear 318 is connected by a drive shaft 319 to collimator drive spur gear 320 positioned outside the bracket 302. The drive spur gear 320 meshes with the toothed portion 200 of the segmental drive gear 198 to effect adjustment of the transverse collimator vanes.

The transverse shutter assembly also can be controlled manually. The knob 52 is carried by a shaft 322 which also carries a manual drive spur gear 324. The manual drive gear 324 is in driving relationship with the field size indicator disc 38. The disc 38 is supported by a shaft 326. A bevel gear 328 is fixed to the shaft 326 and meshes with another bevel gear 338 carried by the drive shaft 319. When the transverse motor subassembly 312 is energized to control the position of the transverse vanes and shutters, the field size indicator disc 38 will be driven through the bevel gearing to indicate to the operator the position of the shutters and vanes. On the other hand, if power to the collimator should fail, or if the operator wishes to select the field size manually, rotation of the knob 52 will, through the bevel gearing and the spur gear 320, produce the desired movement in the transverse shutters. An advantage of the foregoing gearing arrangement is that the shutter assembly can be driven manually without rotating the motor because the clutch 315 readily will slip. Prior manual shutter controls really were manual motor position controls and not manual shutter controls, as such.

Figure 11:
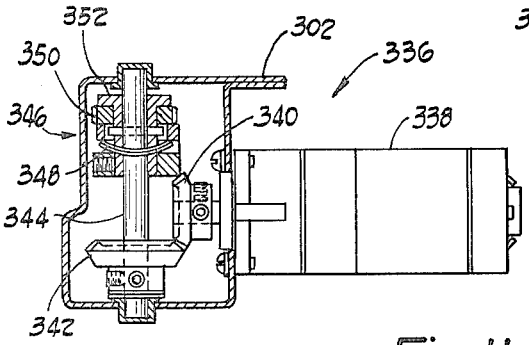
FIG. 11 is an enlarged view of a longitudinal motor assembly as seen from the plane indicated by the light 11—11 of FIG. 9.

A portion of the control circuitry for the collimator 20 includes a transverse vane control potentiometer indicated generally by the arrow 332, FIG. 11. The potentiometer 332 functions to provide an electrical signal of a value indicative of the position of the transverse shutter assembly. A potentiometer drive spur gear 334 to turn a potentiometer input shaft whenever the transverse vanes are adjusted either automatically or manually.

A longitudinal vane motor assembly 336 (FIG. 17) drives the longitudinal shutters 114, 116 and the longitudinal vanes 228, 230. The longitudinal motor assembly 336 includes a gear motor 338. An output bevel gear 340 is fixed to the output shaft of the motor 338 to drive a coacting bevel gear 342. The coacting bevel gear 342 is secured to a shaft 344 which is journaled for rotation on the drive assembly frame 302. A slip clutch 346 which is similar to the clutch 315, is carried by the shaft 344. The slip clutch 346 includes curved washers 348 which are under compression to transmit torque from the gearmotor 338 via the bevel gears 340, 342 and the shaft 344. The torque is transmitted by the clutch 346 to a longitudinal shutter drive spur gear 350 that is concentrically mounted on a drive collar 352 threaded on the shaft 344. The threading of the collar 352 on the shaft 334 permits the clutch spring compression to be adjusted for slippage when torque in excess of a predetermined maximum is attained.

A longitudinal vane field size, control shaft 354 is journaled in the frame 302, FIG. 10. A field size control spur gear 356 is mounted on the field size shaft 354 and in driving relationship with the shutter drive spur gear 350. The field size indicator disc 40 is mounted on an end of the field size shaft 354 remote from the field size spur gear 356. The field size control spur gear 356 is in driving engagement with toothed portion 217 of the longitudinal shutter drive gear 216. Accordingly, motor driven longitudinal vane adjustment is achieved through the longitudinal slip clutch 346 and the spur gears 350, 356.

A manual longitudinal shutter drive spur gear, identical to the spur gear 324, is secured to the longitudinal shutter control knob 54 and connected with the field size indicator disc 40. Accordingly, rotation of the longitudinal field size knob 54 drives the disc 40 through the gear, not shown, and the disc 40 in turn drives the field size control spur gear 356 to effect manual longitudinal shutter adjustment.

The frame 302 also supports an S.I.D. drive shaft 357, FIG. 11. An S.I.D. spur gear 358 is secured to the shaft 357 between the frame 302 and the front panel 28. The S.I.D. shaft 357 extends through the front panel 28 and the S.I.D. selector knob 50 is attached to it. The windowed S.I.D. selector discs 42, 44 each are rotatively driven by the S.I.D. spur gear 358. Accordingly, upon rotation of the knob 50, the S.I.D spur gear 358 and, hence, the S.I.D. selector discs 42, 44 are rotated. An S.I.D. spring-biased detent mechanism 359 (FIG. 10) engages the gear 358 to index the S.I.D. selector discs 42, 44.

V. The Centering Light Assembly 360

The centering light assembly 360 performs two basic functions: it provides a visual indication of the area of the X-ray beam 21 and it provides a thin fan shape centering light beam to enable the collimator to be centered on the center of an X-ray film-carrying tray.

Figure 8:
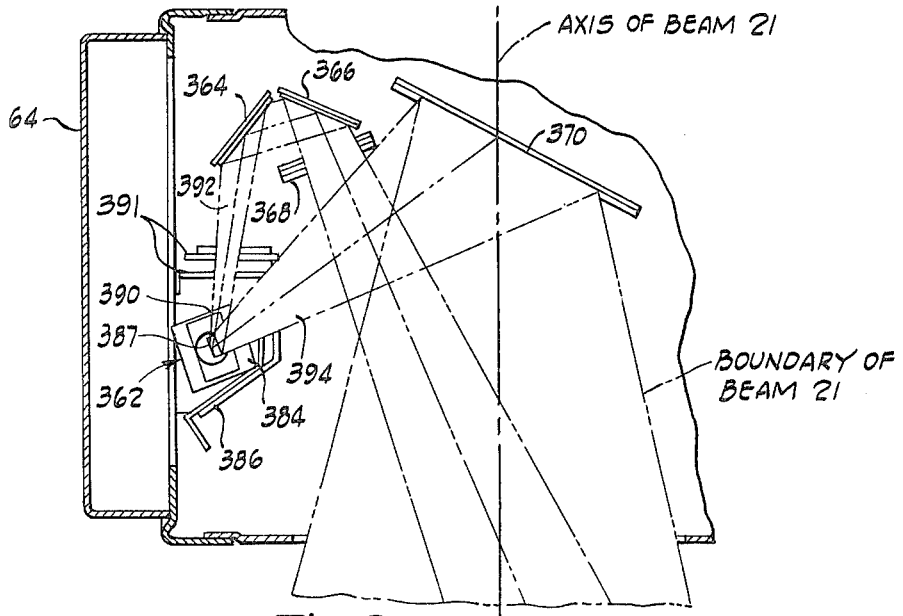
FIG. 8 is a cross-sectional view of the positioning light assembly with parts broken away and removed for clarity.

The centering light arrangement is an improvement over, but is used in the same manner as, the light described in the Centering Patent. Referring to FIGS. 5 and 8, the centering light assembly 360 includes a light source sub assembly 362 and a pair of light beam mirrors 364, 366. A cylindrical lens 368 is provided to focus the light beam and a membrane mirror 370 is provided for beam size indication.

The bottom window 36 includes the crosshairs 37 which are conventional and are located at right angles. The window 36 is secured in place within the housing 22 by clamps 378, 380 which are secured to the housing 22 by fasteners 382.

The light source sub assembly 362 includes a housing 384 secured to the rear panel 30 by a bracket 386. A lamp 387 is disposed within the housing 384. A motor-driven cooling fan 388 is disposed near the housing 362. The fan 388 is mounted within apertured fan cover assembly 64 behind the rear panel 30.

The housing 362 includes a fan beam light opening 390 in its upper surface. The fan beam opening 390 together with apertured beam delineating plates 391 and the lens 368 produce a thin beam of light 392. The beam 392 is projected onto the first light beam mirror 364, reflected to the second light beam mirror 366 which reflects the beam through the lens 368. This beam of light 392 is projected onto an X-ray film-carrying tray to enable the collimator and the tray to be relatively positioned.

The housing 362 has a second light opening 394 through which an X-ray simulating beam of light 396 projects. The simulating light beam 396 reflects off the membrane mirror and then through the window 36.

The lamp 387 is positioned such that its filament is spaced from the mirror a distance equal to the spacing of the X-ray tube focal spot 16 from the mirror. With this arrangement the length of the path of the simulating beam 396 is identical to the length of the path of X-ray beam 21 when radiographic studies are being conducted.

As an operator is setting up for a given diagnostic procedure, adjustment of the collimator shutters delineates the longitudinal and transverse dimensions of the simulating beam 396. Accordingly, the beam 396 illuminates a portion of the patient corresponding exactly to that portion of the patient which will be struck by the X-ray beam 21 when the radiograph is made.

VI. The Filter Assembly 440

The filter assembly 440 is accessible from the right hand side of the collimator as viewed in FIG. 1. It is positioned in the collimator 20 at a location intermediate the off-focus vane assembly 104 and the main shutter assembly 102. To facilitate access, the filter assembly 440 is a drawer-like mechanism which is removable from the collimator 20 through an opening in the side panel 32.

Figure 14:
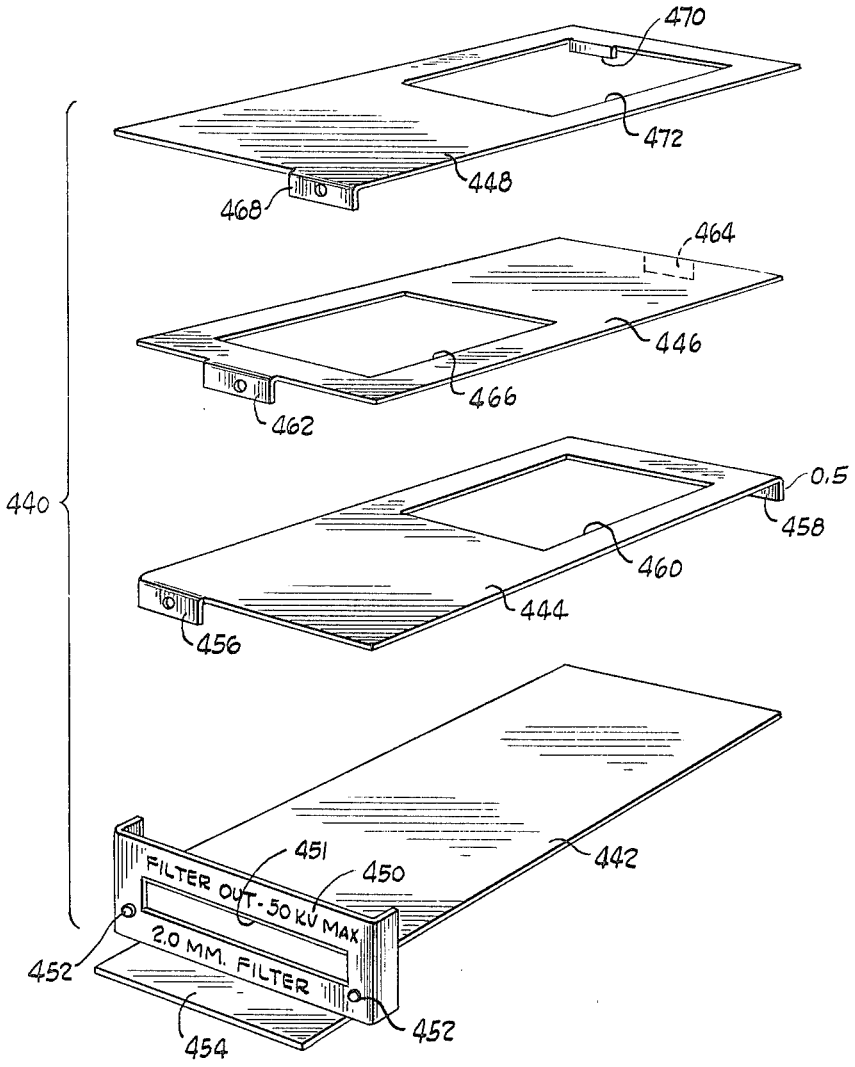
FIG. 14 is an exploded view of filter plates.

The filter assembly 440 includes a plurality of stacked main and supplemental aluminum filter plates 442, 444, 446, 448 (FIG. 14) which may be fitted together in different combinations to provide a desired filtering capacity. The assembly 440 also includes a filter plate receptacle 449 which receives the stacked plates in sliding relationship.

The main filter plate 442 includes a downwardly turned flange and lip 454 at its outer end, A filter assembly locating end wall 450 having an aperture 451 is secured by fasteners 452 to the flange and lip 454. Spacers 453 are fitted between the flange and the end wall to provide a space into which portions of the other plates can extend. The flange and lip 454 also acts as a finger grip by which the filter assembly 442 can be moved into or out of position within the receptacle 449.

The supplemental plates 444, 446 and 448 each have a pair of spaced end tabs respectively designated as 456, 458 and 462, 464 and 468, 470. The supplemental plates respectively have rectangular apertures 460, 466, 472. Each plate may be inserted, apertured end first, so that when its aperture is aligned with the X-ray beam it has no filtration effect. Alternately each plate may be inserted apertured end last to provide a filtration effect. Thus the supplemental filters are always maintained within the collimator but the desired filtration effect may be selected by appropriately positioning the supplemental filter plates.

The supplemental filter plate end tabs are laterally staggered so that the end tab at the innermost end will overlie the rear edge of the main filter plate 442 and its forward tab will fit in a slot defined by the filter locating end wall 450 and the flange and lip 454.

When viewed from the end (FIG. 13) the receptacle 449 is a channel-like member having upturned, inwardly facing side channels 476, 478 within which the tabs of the filter plates are received. The receptacle 449 includes a bottom plate 480 having a rectangular opening 482, FIG. 12, slightly larger than the supplemental filter plate apertures 460, 466, 472. The opening 482 is aligned with the X-ray beam 21 so that if no filter plates are present, no attenuation of the X-ray beam will occur.

A pair of spaced detent pins 484, 486 are provided to retain the stacked filter plates in place and properly aligned with the opening 482. The detent pins 484, 486 are rounded at their upper ends and are secured at their lower ends to flexible spring fingers 488, 490. The opening fingers 488, 490 are secured to the underside of the bottom plate 480 by fasteners 492. The underside of the main plate 442 is provided with indentations into which the detent pins 482, 486 are urged when the filter is properly inserted completely into the receptacle 449.

Figure 12:
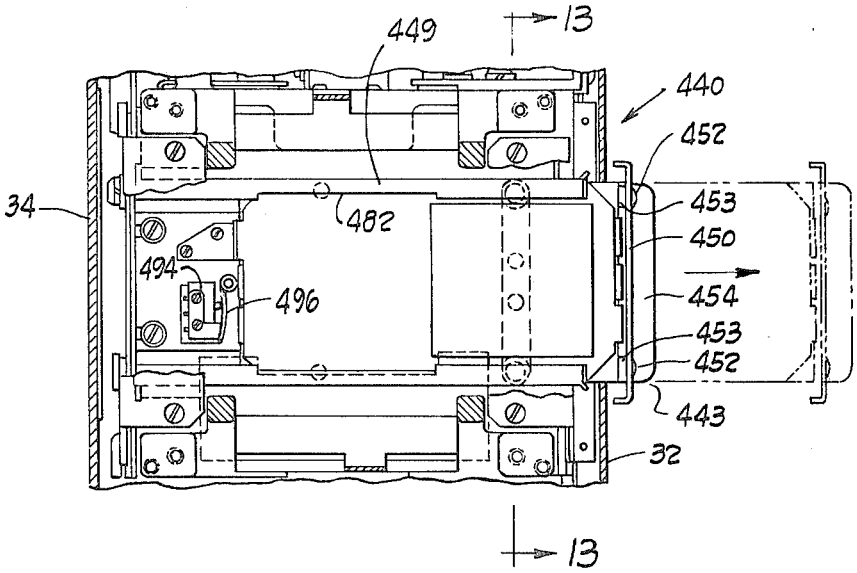
FIG. 12 is a plan view, partly in section, of the radiation filter sub assembly.
Figure 13:
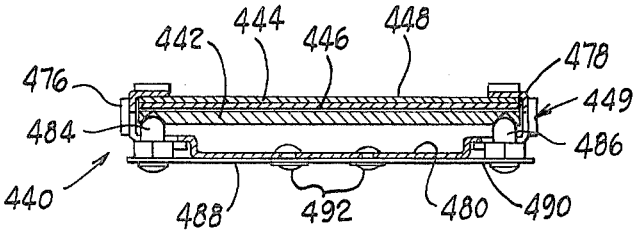
FIG. 13 is a view as seen from the plane indicated by the line 13—13 of FIG. 12 showing a detent mechanism employed to retain filter plates in position.

A limit switch 494 is attached to the bottom plate 480 at a location remote from the opening in the side panel 32, FIG. 12. The limit switch includes a contact arm 496 which is engaged by the end of the plate 442 when the plate 442 is inserted completely into the receptacle 449. The limit switch 494 performs a control function which is that when the filter is removed, the contact arm 496 is moved enough to trip the limit switch. An electrical signal is generated which prevents generation of X-rays at a tub voltage potential of over 50 kilowats. When the plate 442 is in place within the receptacle 449 the switch 494 will be tripped and operation of the X-ray tube 12 at voltage levels over 50 kv. is possible.

VII. The Control System 500

Figure 15:
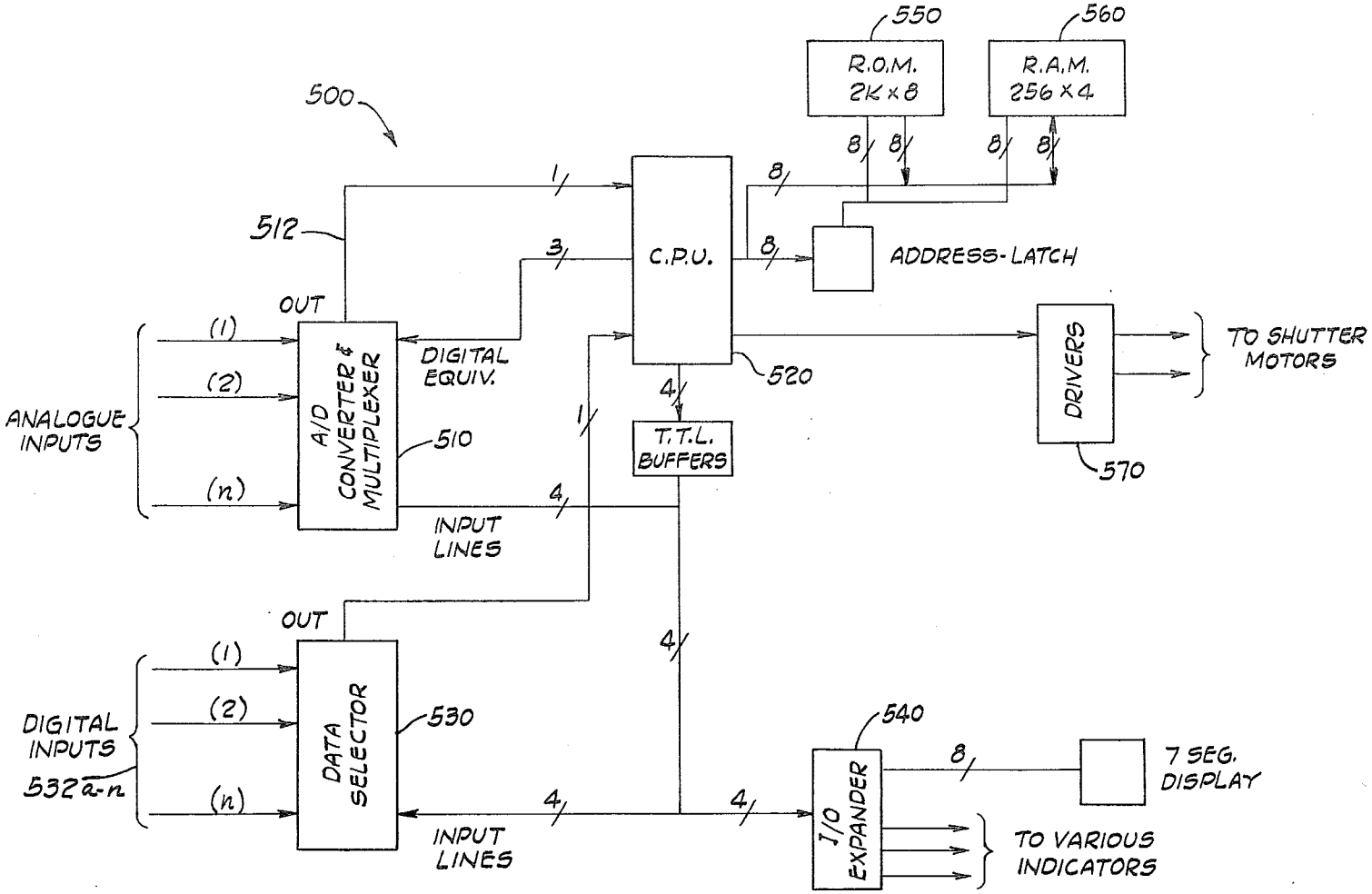
FIG. 15 is a schematic diagram of an electrical control.

FIG. 15 illustrates one control system 500 which can conveniently be utilized to automatically control operation of the improved collimator. The system 500 includes a number of inputs both digital and analog which control operation of a micro-processor 520. Depending on the state of these various inputs, signals to the micro-processor help condition a driver 570 which in turn controls driving motors 312, 336 within the drive assembly 300.

The improved collimator may be utilized in a number of conditions under other than a typical embodiment where the collimator is in a vertical position placed above a table which supports the patient. A number of digital inputs 532*a–n* indicate to the micro-processor 520 which of these conditions the collimator is positioned. The digital inputs might, for example, indicate the X-ray film was mounted on a wall with the X-ray propagation in a horizontal direction and the collimator positioned parallel to the floor. For illustration purposes, it will be assumed that the collimator is positioned in a vertical orientation and the X-ray source sends X-rays to a table Bucky tray supported X-ray film. This orientation will be characterized by a unique configuration of digital inputs to a data selector 530 within the control system 500.

In order to operate in the so called positive beam limitation mode, it is necessary for the micro-processor to receive information concerning the source to image distance. The SID is one of the analog inputs to the control system 500. The SID can be changed to one of four different conventional values and this distance is represented by an analog input which varies as the SID changes.

As the SID changes, the proper diaphragm opening also changes. This proper diaphragm opening is a function of the SID distance and the control system 500 includes a method for comparison of the actual field size as defined by the diaphragm openings with an optimum field size as calculated by the microprocessor. In order to calculate this optimum field size, the micro-processor must be instructed as to which SID is being utilized. Therefore, the analog SID input to the control system is necessary for micro-processor functioning and control.

The proper field size calculation takes place in a micro-processor, but is controlled by the operation of two memory units 550, 560. One unit 550 is dedicated read only memory which contains a preprogrammed algorithm instructing the processor what steps to perform. The second memory unit 560 is programmed by the user and instructs the micro-processor what field sizes are appropriate for a given SID. The ram or random access memory unit 560 is programmed through an input/output expander 540. As programmed by the user, the ram memory unit is capable of calculating the proper field dimensions for a given SID and does so in response to instructions from the central processing unit or the micro-processor 520. Once the proper field dimensions have been calculated they are sent to a converter and multi-plexer unit 510.

As the micro-processor is sending output signals indicative of the optimum field size the potentiometer units in the transverse and longitudinal drive assemblies are sending analog inputs to the control system 500 indicative of the actual field size as defined by the collimator shutter settings. This analog information is converted to digital signals in a converter and compared to the control signals generated by the micro-processor 520. The comparison between actual and optimum field size results in an output from the converter and multiplexer 510 which instructs the micro-processor whether a discrepancy exists between optimum and actual field sizes. If there is a difference between these two values, output 512 results in a micro-processor output to the driver 570 instructing that driver to power the collimator motors 312, 336 in a direction which will narrow the discrepancy between actual and optimum field size. If the field size is already at the optimum or nearly at that level, no driver signal is generated and the collimator diaphragm opening is maintained at a constant level.

The present collimator design allows the user to manually override these control signals as generated by the micro-processor. If the user wishes to drive the diaphragms to a position where the exposure field is less than the optimum size for the particular SID in use, he can manually override the control signals causing the clutch mechanism within the control assembly 300 to slip. When this is done the field of the exposure can be reduced and although the micro-processor sends control signals to change the smaller field size, these signals are overriden by the user's manual control due to slippage in the clutch mechanism. When the user releases this manual override, the micro-processor again regains control of the system apertures causing the field size to automatically return to its optimum calculated size.

What is claimed is:

1. An X-radiation collimator including a frame and having a beam axis comprising:

(a) a plurality of pivotally mounted shutters arranged in paired relationship to delineate the perimeter of an X-ray beam of generally rectangular cross-sectional configuration;

(b) certain pairs of said shutter members being positioned to delineate two parallel and spaced sides of the beam;

(c) the shutters of each of said certain pairs being connected together by a plurality of links;

(d) the links being pivotally interconnected in a parallelogram relationship and being pivotally mounted on the collimator frame; and (e) each of the shutters of said certain pair having an open position wherein one of the shutters is in a nested relationship above the other when the axis is vertical to delineate a full open position and each shutter of said certain pairs having a full closed position wherein a first of the shutters of each certain pair is in touching relationship with the other first shutter and the remaining shutters of the certain pairs are outward relative to the first shutters and each remaining shutter is in overlapping relationship with its first shutter whereby to fully block the exit of an X-ray beam from the collimator.

2. The collimator of claim 1 wherein a drive gear train is coupled to the pairs of shutters and wherein both a manual control and a motor are connected to the gear train and wherein the gear train includes a slip clutch.

3. In a radiographic X-ray collimator an off-focus vane assembly comprising:

(a) orthogonally oriented pairs of guide tracks positioned generally symmetrically about an axis of the collimator and of the X-ray beam to be delineated;

(b) two pairs of off-focus vanes with one pair of vanes being reciprocally mounted on one pair of guide tracks and the other pair of vanes reciprocally mounted on the other pair of guide tracks;

(c) the vanes including a plurality of interfitting arms disposed laterally of any plane located by the axis of an X-ray beam to be delineated; and (d) an on focus shutter assembly and linkage means interconnecting the on focus shutter assembly and the off focus vanes whereby adjustment of the shutter assembly will cause concurrent and coordinated off field vane adjustment.

4. For use in a radiographic collimator, a filter assembly comprising:

(a) a main filter of generally rectangular configuration;

(b) a plurality of supplemental filters each of an overall configuration corresponding to that of the main filter and each including a through aperture and a filtering portion; and (c) each of the supplemental filters being adapted to be positioned with either its aperture aligned with the filtering portion of the main filter such that it is in a nonfiltering stored orientation, or with its filtering portion aligned with the filtering portions for the main filter to provide filtration additive to that of the main filter.

5. The filtering arrangement of claim 4 wherein each of the supplemental filters has end locating tabs for overlying the ends of the main filter and wherein the tabs of one supplemental filter are transversely offset from the tabs of each other supplemental filter.

6. The device of claim 5 wherein an end plate is secured to the main filter at least partially in spaced relationship to provide a space to receive one of the tabs of each of the supplemental filters.

7. A radiation collimator comprising:

(a) an X-ray source for emitting a beam of X-radiation;

(b) diaphragm means for delineating an on focus beam;

(c) off-focus collimator means connected to said diaphragm means for co-ordinate movement, said means including opposed portions confined substantially to a plane intermediate the source and diaphragm means and moveable relative to each other to block off-focus radiation; and (d) drive means for moving said opposed portions in said plane.

8. A radiation collimator comprising:

(a) an X-ray source for emitting a beam of X-radiation;

(b) diaphragms for delineating the beam;

(c) drive means coupled to the diaphragms to provide movement to said diaphragms and including a clutch;

(d) adjustment means coupled to the drive means for manually adjusting the diaphragm position by causing the clutch to slip thereby adjusting the beam delineation; and (e) automatic means for positioning of the diaphragms if said diaphragms have been manually positioned to delineate a beam too large for existing conditions.

9. A radiation collimator comprising:

(a) an X-ray source for emitting a beam of radiation;

(b) diaphragms for delineating the beam; said diaphragms including a first and second radiation absorption structures;

(c) drive means including a gear mounted for rotational movement;

(d) a mount; and (e) linkage structure connected to said diaphragms; and drive means and said mount for transmitting motion from the rotating drive means to the diaphragm; said linkage including;

(i) a first arm attached to the first absorption structure and to the mount;

(ii) a second arm attached to the second absorption structure and to the mount; and (iii) first and second gear means connected to said first and second arms respectively and meshing with each other to coordinate movement of said first and second arms.

10. A radiation collimator comprising:

(a) an X-ray source for emitting a beam of X-radiation;

(b) diaphragm means for delineating the beam to a field;

(c) centering means including a light source for sending a visible light signal to a portion of the field thereby enabling a user to position the non-visible X-radiation;

(d) said centering means including a partially reflective mirror positioned within the beam for receiving visible light from a source and for reflecting it to the plane of X-ray exposure; and (e) field illuminating means including said light source for illuminating an X-ray beam stimulating field.

11. A radiographic collimator including a frame and having a beam axis comprising:

(a) a plurality of pivotally mounted shutters arranged in paired relationship to delineate the perimeter of an X-ray beam of generally rectangular cross-sectional configuration;

(b) certain pairs of said shutter members being positioned to delineate two parallel and spaced sides of the beam;

(c) the shutters of each of said certain pairs being connected together by a plurality of links;

(d) the links being pivotally interconnected in a parallelogram relationship and being pivotally mounted on the collimator frame;

(e) each of the shutters of said certain pairs having an open position wherein one of the shutters is in a nested relationship above the other when the axis is vertical to delineate a full open position and each shutter of said certain parts having a full closed position wherein a first of the shutters of each certain pair is in touching relationship with the other first shutter and the remaining shutters of the certain pair are outward relative to the first shutters and each remaining shutter is in overlapping relationship with its first shutter whereby to fully block the exit of an X-ray beam from the collimator;

(f) orthogonally oriented pairs of guide tracks positioned generally symmetrically about an axis of the collimator and of the X-ray beam to be delineated;

(g) two pairs of off-focus vanes with one pair of vanes being reciprocably mounted on the pair of guide tracks and the other pair of vanes reciprocally mounted on the other pair of guide tracks;

(h) the vanes including a plurality of interfitting arms disposed laterally of any plane located by the axis of an X-ray beam to be delineated; and (i) a linkage interconnecting the shutters and the off focus vanes whereby adjustment of the shutters will cause concurrent and coordinated off field vane adjustment.

12. The radiographic collimator of claim 11 wherein a filter assembly is provided and positionable between the vanes and shutters, the filter assembly comprising:

(a) a main filter of generally rectangular configuration;

(b) a plurality of supplemental filters each of an overall configuration corresponding to that of the main filter and each including a through aperture and a filtering portion; and (c) each of the supplemental filters being adapted to be positioned with either its aperture aligned with the filtering portion of the main filter such that it is in a nonfiltering stored orientation, or with its filtering portion aligned with the filtering portions for the main filter to provide filtration additive to that of the main filter.

13. The radiographic collimator of claim 12 further including a centering means including a light source for sending a visible light signal to a portion of the field thereby enabling a user to position the non-visible X-radiation; said centering means including a partially reflective mirror positioned within the beam for receiving visible light from a source and for reflecting it to the plane of X-ray exposure; and field illuminating means including said light source for illuminating an X-ray beam simulating field.

14. The radiographic collimator of claim 11 wherein there is an adjustment means for manually adjusting the shutter and vane positions and thereby adjusting the beam delineation; and an automatic means is provided overriding said manual means to control positioning of the shutters whenever the shutters have been manually positioned to delineate a beam too large for existent conditions.

15. An X-radiation collimator including a frame and having a beam axis comprising:

(a) a plurality of pivotally mounted shutters arranged in paired relationship to delineate the perimeter of an X-ray beam of generally rectangular cross-sectional configuration;

(b) certain pairs of said shutter members being positioned to delineate two parallel and spaced sides of the beam;

(c) the shutters of each of said certain pairs being connected together by a plurality of links;

(d) the links being pivotally interconnected in a parallelogram relationship and being pivotally mounted on the collimator frame; and (e) each of the shutters of said certain pairs having an open position wherein one of the shutters is in a nested relationship above the other when the axis is vertical to delineate a full open position and shutters of the certain pairs having a full closed position wherein a first of the shutters of each certain pair is in touching relationship with the other first shutter and the remaining shutters of the certain pairs are outward relative to the first shutters and each remaining shutter is in overlapping relationship with its first shutter whereby to fully block the exit of an X-ray beam from the collimator; and another of said shutter pairs being pivotally mounted within paths through which the interconnected certain shutter pairs move in their adjustment range.

16. The collimator of claim 15 wherein a pair of drive gear trains are coupled to the pairs of shutters and wherein both a manual control and a motor are connected to each gear train and wherein each gear train includes a slip clutch.

* * * * *

UNITED STATES PATENT AND TRADEMARK OFFICE

CERTIFICATE OF CORRECTION

PATENT NO. : 4,246,488

DATED : January 20, 1981

INVENTOR(S) : Michael Hura

It is certified that error appears in the above-identified patent and that said Letters Patent are hereby corrected as shown below:

Col. 1, line 16, change "collmator" to --Collimator"
Col. 1, line 51, after "film." new paragraph should be started.
Col. 2, line 42, after "arrangement." delete "A".
Col. 2, line 62, change "fails" to --fail--
Col. 3, line 7, change "adapted" to --adopted--
Col. 3, line 46, after "housing" change "with" to --and--
Col. 3, line 51, change "the" to --a --

Col. 5, line 8, after "panel" insert --28--
Col. 5, line 13, change "52" to --54--
Col. 6, line 22, change "biaased" to --biased--
Col. 6, line 23, omit the word "out"
Col. 6, line 64, after "made." new paragraph should be started.
Col. 7, line 13, insert "," between 162 and 164
Col. 7, line 31, change "bottonhead" to --buttonhead--
Col. 8, line 52, change "them" to --the--
Col. 11, line 65, change "end," to --end.--
Col. 15, line 55, change "and" (first occurence) to --said--
Col. 16, line 12, change "stimulating" to --simulating--
Col. 16, line 36, change "pair" to --pairs--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*